US010639706B2

(12) United States Patent
Volks

(10) Patent No.: US 10,639,706 B2
(45) **Date of Patent: *May 5, 2020**

(54) FEEDER SYSTEM

(71) Applicant: FOSECO INTERNATIONAL LIMITED, Derbyshire (GB)

(72) Inventor: Christof Volks, Velen (DE)

(73) Assignee: FOSECO INTERNATIONAL LIMITED, Barlborough Links (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/218,584

(22) Filed: Dec. 13, 2018

(65) Prior Publication Data

US 2019/0255600 A1 Aug. 22, 2019

Related U.S. Application Data

(63) Continuation of application No. 15/756,748, filed as application No. PCT/GP2015/052529 on Sep. 2, 2015, now Pat. No. 10,286,445.

(51) Int. Cl.
*B22C 9/08* (2006.01)

(52) U.S. Cl.
CPC ..... *B22C 9/088* (2013.01); *B22C 9/084* (2013.01)

(58) Field of Classification Search
CPC ..... B22C 9/088; B22C 9/084
See application file for complete search history.

(56) References Cited

U.S. PATENT DOCUMENTS 5,915,450 A 6/1999 Aufderheide et al.
6,904,952 B2 6/2005 Skerdi et al.
(Continued)

FOREIGN PATENT DOCUMENTS

CN 203281811 U 11/2013
CN 203541446 U 4/2014
(Continued)

OTHER PUBLICATIONS

International Search Report for PCT/GB2015/052529, dated May 30, 2016, 3 pages.
(Continued)

*Primary Examiner* — Kevin P Kerns
*Assistant Examiner* — Steven S Ha
(74) *Attorney, Agent, or Firm* — Nixon & Vanderhye PC

(57) ABSTRACT

A feeder system for metal casting comprising a feeder sleeve mounted on a tubular body. The feeder sleeve has a first end and a second end and a longitudinal axis extending generally between said first and second ends. The feeder sleeve comprises a continuous sidewall that extends generally around the longitudinal axis that defines a cavity for receiving liquid metal during casting and the sidewall has a base at the first end of the feeder sleeve. The tubular body defines an open bore therethrough for connecting the cavity to the casting in use. The feeder sleeve comprises at least one cut-out that extends into the sidewall from the base to a first depth and the tubular body projects into the cut-out to a second depth, the tubular body having at least one abrading region in contact with a surface of the feeder sleeve within the cut-out. The second depth is equal to or less than the first depth so that upon application of a force in use the abrading region abrades the surface of the feeder sleeve with which it is in contact such that the tubular body is pushed towards the second end. The invention also resides in a feeder sleeve for use in the system and a process for preparing a casting mould employing the system.

17 Claims, 5 Drawing Sheets

(56) References Cited

U.S. PATENT DOCUMENTS

| | | | |
|---|---|---|---|
| 7,320,355 | B2 | 1/2008 | Skerdi |
| 9,968,993 | B2 | 5/2018 | Volks |
| 2005/0236132 | A1 | 10/2005 | Powell et al. |
| 2008/0223543 | A1 | 9/2008 | Skerdi |
| 2008/0230201 | A1 | 9/2008 | Skerdi |
| 2008/0265129 | A1 | 10/2008 | Skerdi |
| 2009/0301684 | A1 | 12/2009 | Beckmann et al. |
| 2015/0283602 | A1 | 10/2015 | Schafer |
| 2017/0182547 | A1 | 6/2017 | Volks et al. |
| 2018/0250735 | A1 | 9/2018 | Volks |
| 2018/0290203 | A1 | 10/2018 | Volks et al. |

FOREIGN PATENT DOCUMENTS

| | | |
|---|---|---|
| DE | 2334501 | 3/1975 |
| DE | 29510068 | 10/1996 |
| DE | 20112425 | 10/2001 |
| DE | 202004021109 | 10/2006 |
| DE | 102007012117 | 9/2008 |
| DE | 102008009730 | 8/2009 |
| DE | 202011050109 | 9/2012 |
| DE | 202013102133 | 5/2013 |
| DE | 202013001933 | 5/2014 |
| EA | 14660 | 12/2010 |
| EP | 0265112 | 4/1988 |
| EP | 1 184 104 | 3/2002 |
| EP | 1775045 | 4/2007 |
| EP | 2 792 432 | 10/2014 |
| GB | 1 597 832 | 9/1981 |
| GB | 2141649 | 1/1985 |
| JP | 63-101042 | 5/1988 |
| JP | 2004-532737 | 10/2004 |
| JP | 2007-509760 | 4/2007 |
| JP | 2008-531287 | 8/2008 |
| JP | 2009-006401 | 1/2009 |
| JP | 2009-539612 | 11/2009 |
| JP | 2010-510071 | 4/2010 |
| SU | 83278 | 10/1950 |
| WO | 97/01406 | 1/1997 |
| WO | WO 2005/051568 | 6/2005 |
| WO | 2005/095020 | 10/2005 |
| WO | WO 2007/141446 | 12/2007 |
| WO | WO 2007/141466 | 12/2007 |
| WO | WO 2012/110753 | 8/2012 |
| WO | WO 2013/171439 | 11/2013 |
| WO | 2014/083155 | 6/2014 |

OTHER PUBLICATIONS

International Preliminary Report on Patentability dated Mar. 15, 2018 in corresponding International Application No. PCT/GB2015/052529, 10 pages.

Search Report dated Jan. 22, 2015 in related GB Application No. 1415516.2, 3 pages.

International Search Report dated Dec. 7, 2015 in related Application No. PCT/GB2015/052528, 13 pages.

International Search Report dated May 30, 2016 in related Application No. PCT/GB2015/052529, 11 pages.

International Search Report dated Sep. 2, 2015 in related Application No. PCT/GB2015/052530, 13 pages.

Stefan A. Fischer et al., "Die Entwicklung leistungsstarker Speisungshilfsmittel zur Steigerung der Gussqualität", Giesserei, vol. 100, No. 8, Aug. 1, 2013, pp. 54-61, XP001588478.

"Foseco Feedex K Sleeves Improve Productivity and Process Control", Foundry Trade Journal, Institute of Cast Metals Engineers, West Bromwich, GB, vol. 179, No. 3624, May 1, 2005, p. 99, XP001236991.

Office Action dated Jul. 25, 2018 in related Russian Application No. 2017103294/02(005717), 7 pages.

Office Action dated Aug. 27, 2018 in related Russian Application No. 2017103294/02(005717) (with translation), 10 pages.

Office Action dated Oct. 16, 2018 in related Japanese Application No. 2017-512301 (with partial translation), 4 pages.

Office Action dated Oct. 16, 2018 in related Japanese Application No. 2017-512309 (with partial translation), 7 pages.

International Search Report for PCT/GB2015/052530, dated Jun. 10, 2016, 4 pages.

Written Opinion of the ISA for PCT/GB2015/052530, dated Jun. 10, 2016, 6 pages.

Office Action dated May 28, 2019 in related Japanese Application No. 2018-511636 with summary, 5 pages.

Office Action dated Mar. 28, 2019 in related Chinese Application No. 201580082849.0 (with translation), 13 pages.

FEEDER SYSTEM

CROSS-REFERENCES TO RELATED APPLICATIONS

This application is a continuation of application Ser. No. 15/756,748 filed Mar. 1, 2018, which is a National Phase of International Application No. PCT/GB2015/052529 filed Sep. 2, 2015, the entire contents of each of which are hereby incorporated herein by reference.

TECHNICAL FIELD

The present invention relates to a feeder system for use in metal casting operations utilising casting moulds, a feeder sleeve for use in the feeder system and a process for preparing a mould comprising the feeder system.

BACKGROUND AND SUMMARY

In a typical casting process, molten metal is poured into a pre-formed mould cavity which defines the shape of the casting. However, as the metal solidifies it shrinks, resulting in shrinkage cavities which in turn result in unacceptable imperfections in the final casting. This is a well known problem in the casting industry and is addressed by the use of feeder sleeves or risers which are integrated into the mould, either during mould formation by applying them to a pattern plate, or later by inserting a sleeve into a cavity in the formed mould. Each feeder sleeve provides an additional (usually enclosed) volume or cavity which is in communication with the mould cavity, so that molten metal also enters into the feeder sleeve. During solidification, molten metal within the feeder sleeve flows back into the mould cavity to compensate for the shrinkage of the casting.

After solidification of the casting and removal of the mould material, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity) in a design commonly referred to as a neck down sleeve. When a sharp blow is applied to the residual metal it separates at the weakest point which will be near to the mould (the process commonly known as "knock off"). A small footprint on the casting is also desirable to allow the positioning of feeder sleeves in areas of the casting where access may be restricted by adjacent features.

Although feeder sleeves may be applied directly onto the surface of the casting mould cavity, they are often used in conjunction with a feeder element (also known as a breaker core). A breaker core is simply a disc of refractory material (typically a resin bonded sand core or a ceramic core or a core of feeder sleeve material) with a hole usually in its centre which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the casting surface.

Moulding sand can be classified into two main categories. Chemical bonded (based on either organic or inorganic binders) or clay-bonded. Chemically bonded moulding binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting.

Clay-bonded moulding uses clay and water as the binder and can be used in the "green" or undried state and is commonly referred to as greensand. Greensand mixtures do not flow readily or move easily under compression forces alone and therefore to compact the greensand around the pattern and give the mould sufficient strength properties as detailed previously, a variety of combinations of jolting, vibrating, squeezing and ramming are applied to produce uniform strength moulds at high productivity. The sand is typically compressed (compacted) at high pressure, usually using one or more hydraulic rams.

To apply sleeves in such high pressure moulding processes, pins are usually provided on the moulding pattern plate (which defines the mould cavity) at predetermined locations as mounting points for the feeder sleeves. Once the required sleeves are placed on the pins (such that the base of the feeder is either on or raised above the pattern plate), the mould is formed by pouring moulding sand onto the pattern plate and around the feeder sleeves until the feeder sleeves are covered and the mould box is filled. The application of the moulding sand and subsequent high pressures may cause damage and breakage of the feeder sleeve, especially if the feeder sleeve is in direct contact with the pattern plate prior to ram up, and with increasing casting complexity and productivity requirements, there is a need for more dimensionally stable moulds and consequently, a tendency towards higher ramming pressures and resulting sleeve breakages.

The Applicant has developed a range of collapsible feeder elements for use in combination with feeder sleeves, which are described in WO2005/051568, WO2007141446, WO2012110753 and WO2013171439. The feeder elements compress when subjected to pressure during moulding, thereby protecting the feeder sleeve from damage.

US2008/0265129 describes a feeder insert for inserting into a casting mould used for casting metals, comprising a feeder body having a feeder cavity therein. The bottom side of the feeder body is in communication with the casting mould and the top side of the feeder body is provided with an energy absorbing device.

EP1184104A1 (Chemex GmbH) describes a two-part feeder sleeve (which can be either insulating or exothermic) which telescopes when the moulding sand is compressed; the internal wall of the second (upper) part is flush with the external wall of the first (lower) part.

EP1184104A1 FIGS. 3a to 3d illustrate the telescoping action of the two-part feeder sleeve (102). The feeder sleeve (102) is in direct contact with the pattern (122), which can be detrimental when an exothermic sleeve is employed since it can result in a poor surface finish, localised contamination of the casting surface and even sub-surface casting defects. In addition, even though the lower part (104) is tapered, there is still a wide foot-print on the pattern (122) since the lower part (104) must be relatively thick to withstand the forces experienced during ram-up. This is unsatisfactory in terms of knock-off and the space taken up by the feeder system on the pattern. The lower inner part (104) and the upper outer part (106) are held in position by retaining elements (112). The retaining elements (112) break off and fall into the moulding sand (150) to allow the telescoping action to take place. The retaining elements will build up in the moulding sand over time and thereby contaminate it. This is particularly troublesome where the retaining elements are made from exothermic material since they may react creating small explosive defects.

U.S. Pat. No. 6,904,952 (AS Luengen GmbH & Co. KG) describes a feeder system where a tubular body is temporarily glued to the inner wall of a feeder sleeve. There is relative movement between the feeder sleeve and the tubular body when the moulding sand is compressed.

Increasing demands are being placed on feeding systems for use in high pressure moulding systems, partly due to advances in moulding equipment, and partly due to new castings being produced. Certain grades of ductile iron and particular casting configurations may adversely influence the effectiveness of feed performance through the neck of certain metal feeder elements. Additionally, certain moulding lines or casting configurations may result in over compression (collapsing of the feeder element or telescoping of the feeder system) resulting in the base of the sleeve being in close proximity to the casting surface separated by only a thin layer of sand. The present invention provides a feeder system for use in metal casting and seeks to overcome one or more problems associated with prior art feeder systems or to provide a useful alternative.

According to a first aspect of the present invention there is provided a feeder system for metal casting comprising a feeder sleeve mounted on a tubular body;

the feeder sleeve having a first end and a second end and a longitudinal axis extending generally between said first and second ends, and comprising a continuous sidewall extending generally around the longitudinal axis that defines a cavity for receiving liquid metal during casting, the sidewall having a base at the first end of the feeder sleeve; the tubular body defining an open bore therethrough for connecting the cavity to the casting, wherein at least one cut-out extends into the sidewall from the base to a first depth and the tubular body projects into the cut-out to a second depth, the tubular body having at least one abrading region in contact with a surface of the feeder sleeve within the cut-out and the second depth being equal to or less than the first depth so that upon application of a force in use the abrading region abrades the surface of the feeder sleeve with which it is in contact such that the tubular body is pushed towards the second end.

In use the feeder system is mounted on a mould pattern, typically placed over a moulding pin attached to the pattern plate to hold the system in place, such that the tubular body is next to the mould. The open bore defined by the tubular body provides a passage from the feeder sleeve cavity to the mould cavity to feed the casting as it cools and shrinks. During moulding and subsequent ram-up, the feeder system will experience a force in the direction of the longitudinal axis of the tubular body (the bore axis). This force pushes the feeder sleeve onto the tubular body so that the tubular body either abrades the sides of the cut-out if initially it only projects partially into the cut-out ($D2<D1$), or abrades the body of the feeder sleeve at the base of the cut-out if the tubular body is initially fully in the cut-out ($D2=D1$), effectively making the cut-out deeper. Hence, the high compression pressure causes relative movement between the feeder sleeve and the tubular body rather than uncontrolled breakage of the feeder sleeve that may result in defects in the casting. Typically the feeder system will experience a ram up pressure (as measured at the pattern plate) of at least 30, 60, 90, 120 or 150 $N/cm^2$.

U.S. Pat. No. 6,904,952 FIGS. 2a-2b shows a tubular body (3) glued inside the cavity of a feeder sleeve (1) by means of a hot glue seam (7). During moulding the feeder sleeve (1) separates from the tubular body (3) and is forced further onto the tubular body; the new position is illustrated by the hatching. No abrasion takes place.

In one embodiment the cut-out is a groove in the sidewall i.e. separate from the feeder sleeve cavity. In one such embodiment the groove is located at least 5, 8 or 10 mm from the feeder sleeve cavity. In this embodiment the part of the tubular body that overlaps with the feeder sleeve is within the sidewall and not in direct contact with liquid metal during casting. This not only minimises any chilling effect, but also results in superheating of the tubular body when exothermic feeders are used; both sides of the metal tubular body are in direct intimate contact with the overlapping part of the exothermic feeder, and therefore ensure the feeder metal remains liquid sufficiently long enough to feed the casting.

In another embodiment the cut-out and the cavity are contiguous. In one such embodiment the end of the cut-out is defined by a ledge in the sidewall. This embodiment provides benefits in terms of ease of manufacture.

Tubular Body

The tubular body serves two functions: (i) the tubular body has an open bore therethrough which provides a passage from the feeder sleeve cavity to the casting mould and (ii) the relative movement of the tubular body and the feeder sleeve serves to absorb energy that could otherwise cause uncontrolled breakage of the feeder sleeve.

In one embodiment the tubular body projects fully into the cut-out i.e. the second depth is equal to the first depth. This means there is no further space for subsequent relative movement within the cut-out. The end of the tubular body in the cut-out abrades the feeder sleeve at the base of the cut-out on ram-up and thereby increases the depth of the cut-out. It will be understood that in this embodiment the abrading region is constituted by the end of the tubular body that is in the cut-out.

In another embodiment the tubular body partially (but not fully) projects into the cut-out so that there is space within the cut-out for subsequent relative movement. i.e. the second depth is less than the first depth. Retaining means may be employed to hold the tubular body in position within the cut-out, and the abrading region may serve as such retaining means. In one such embodiment the cut-out and the tubular body are sized such that the retaining means is a friction fit that holds the tubular body in position prior to ram-up (densification of the moulding sand around the feeder system to produce the mould for casting). Additionally or alternatively, the tubular body is releasably fixed to the feeder sleeve by means of adhesive; the retaining means is adhesive.

It will be understood that the tubular body and the feeder sleeve must be capable of further relative movement during ram-up (in practice the tubular body will remain stationary and the feeder sleeve will move).

In one embodiment the abrading region comprises at least one (radially) outward projection which abuts the feeder sleeve within the cut-out. In one such embodiment the abrading region comprises from 2 to 8 or from 3 to 6 outward projections. In one embodiment where the cut-out is a groove, the tubular body comprises at least one inward projection. An inward projection extends radially towards the bore axis. An outward projection can be preferable to an inward projection if there is a risk that an inward projection could break off and fall into the casting.

In one embodiment the projection is an integral part of the tubular body i.e. the tubular body and the projection(s) are of uniform construction. In one embodiment the integral projection is formed by folding a portion of the tubular body (inwardly or outwardly) to form a tab or overlap. The portion of the tubular body may comprise an edge of the tubular body or may be spaced from an edge of the tubular body. In another embodiment the integral projection is formed as a notch or bulge in the tubular body (away from the peripheral edge). In another embodiment the integral projection is a rib which extends around the entire periphery of the tubular body. The rib can grip the feeder sleeve within the cut-out. The projection may be in the form of a fin located in the peripheral wall of the tubular body.

In one embodiment the abrading region comprises at least one sharp edge (e.g. a blade). A sharp edge can cut or scrape the feeder sleeve material. The sharp edge may be provided on the end of the tubular body in the cut-out or on a fin located on the periphery of the tubular body.

It will be understood that where a sharp edge is provided, the edge will be orientated so that it cuts/abrades the feeder sleeve upon ram up. A peripheral edge will therefore be parallel to the longitudinal axis of the sleeve.

In one embodiment the abrading region comprises at least one sharp point. A sharp point can pierce the feeder sleeve material and may gouge out a channel during ram-up. In one embodiment the abrading region comprises at least 3 sharp points. In one embodiment the sharp point or sharp points extend radially outwards from the tubular body. i.e. the sharp point forms an outward projection.

In one embodiment the abrading region comprises an abrading surface. The abrading surface can be rough or smooth. The abrading surface can be curved or flat.

The size and mass of the tubular body will depend on the application. It is generally preferable to reduce the mass of the tubular body when possible. This reduces material costs and can also be beneficial during casting, e.g. by reducing the heat capacity of the tubular body. In one embodiment the tubular body has a mass of less than 50, 40, 30, 25 or 20 g.

It will be understood that the tubular body has a longitudinal axis, the bore axis. In general the feeder sleeve and the tubular body will be shaped such that the bore axis and the feeder sleeve longitudinal axis are the same. However, this is not essential.

The height of the tubular body may be measured in a direction parallel to the bore axis and may be compared to depth of the cut-out (the first depth). In some embodiments the ratio of the height of the tubular body to the first depth is from 1:1 to 5:1, from 1.1:1 to 3:1 or from 1.3:1 to 2:1.

The tubular body has an inner diameter and an outer diameter and a thickness which is the difference between the inner and outer diameters (all measured in a plane perpendicular to the bore axis). The thickness of the tubular body must be such that it allows the tubular body to project into the cut-out. In some embodiments the thickness of the tubular body is at least 0.1, 0.3, 0.5, 0.8, 1, 2 or 3 mm. In some embodiments the thickness of the tubular body is no more than 5, 3, 2, 1.5, 1, 0.8 or 0.5 mm. In one embodiment the tubular body has a thickness of from 0.3 to 1.5 mm. A small thickness is beneficial for a number of reasons including, reducing the material required to manufacture the tubular body and allowing the corresponding cut-out in the sidewall to be narrow, and reducing the heat capacity of the tubular body and hence the amount of energy absorbed from the feeder metal on casting. The cut-out extends from the base of the sidewall and the wider the cut-out, the wider the base must be to accommodate it.

In one embodiment the tubular body has a circular cross-section. However, the cross-section could be non-circular e.g. oval, obround or elliptical. In one preferred embodiment the tubular body narrows (tapers) in a direction away from the feeder sleeve (next to the casting in use). A narrow portion adjacent the casting is known as a feeder neck and provides better knock off of the feeder. In one series of embodiments, the angle of the tapered neck relative to the bore axis shall be no more than 55, 50, 45, 40 or 35.degree.

To further improve knock off, the base of the tubular body may have an inwardly directed lip to provide a surface for mounting on the mould pattern and produce a notch in the resulting cast feeder neck to facilitate its removal (knock off).

The tubular body can be manufactured from a variety of suitable materials including metal (e.g. steel, iron, aluminium, aluminium alloys, brass, copper etc.) or plastics. In a particular embodiment, the tubular body is made from metal. A metal tubular body can be made to have a small thickness whilst retaining sufficient strength to withstand moulding pressures. In one embodiment the tubular body is not manufactured from feeder sleeve material (whether insulating or exothermic). Feeder sleeve material is not generally strong enough to withstand moulding pressures at small thickness, whereas a thicker tubular body requires a wider cut-out in the sidewall and therefore increases the size (and associated cost) of the feeder system as a whole. Additionally, a tubular body comprising feeder sleeve material may also cause poor surface finish and defects where it is in contact with the casting.

In certain embodiments where the tubular body is formed from metal, it may be press-formed from a single metal piece of constant thickness. In one embodiment the tubular body is manufactured via a drawing process, whereby a metal sheet blank is radially drawn into a forming die by the mechanical action of a punch. The process is considered deep drawing when the depth of the drawn part exceeds its diameter and is achieved by redrawing the part through a series of dies. In another embodiment, the tubular body is manufactured via a metal spinning or spin forming process, whereby a blank disc or tube of metal is first mounted on a spinning lathe and rotated at high speed. Localised pressure is then applied in a series of roller or tool passes that causes the metal to flow down onto and around a mandrel that has the internal dimensional profile of the required finished part.

To be suitable for press-forming or spin-forming, the metal should be sufficiently malleable to prevent tearing or cracking during the forming process. In certain embodiments the feeder element is manufactured from cold-rolled steels, with typical carbon contents ranging from a minimum of 0.02% (Grade DC06, European Standard EN10130-1999) to a maximum of 0.12% (Grade DC01, European Standard EN10130-1999). In one embodiment the tubular body is made from steel having a carbon content of less than 0.05, 0.04 or 0.03%.

Feeder Sleeve

As discussed above, the cut-out may be contiguous with the cavity or separate from the cavity (i.e. a groove).

The cut-out has a first depth (D1), which is the distance by which the cut-out extends away from the base into the sidewall. Typically, the cut-out has a uniform depth i.e. the distance from the base into the sidewall is the same no matter where it is measured. However, a cut-out of variable depth (e.g. castellated) could be employed if desired and the first depth will be understood to be the minimum depth, since this dictates the extent to which the tubular body can project into the cut-out before abrasion takes place. In one embodiment relative movement is achieved where the cut-out is castellated. In this way there is less feeder sleeve material to be abraded to achieve relative movement.

Before ram-up, the tubular body is received in the cut-out to a second depth (D2) i.e. D21.ltoreq.D1 so the tubular body partially or fully projects into the cut-out. After ram-up, the tubular body projects further into the cut-out to a third depth (D3), which may be deeper than the original depth of the cut-out (D1).

The cut-out (e.g. groove) must be capable of receiving the tubular body. Hence the cross-section of the cut-out (in a plane perpendicular to the bore axis) corresponds to the cross-section of the tubular body e.g. the groove is a circular groove and the tubular body has a circular cross-section. In one embodiment the cut-out is a single, continuous groove. In another embodiment relative movement between a feeder sleeve and a tubular body is achieved with the feeder sleeve having a series of slots and the tubular body having a corresponding shape e.g. a castellated edge. However, care must be taken to ensure that the system is not closed; there is a risk that moulding sand would penetrate into the feeder sleeve through any gaps between the edge of tubular body and the feeder sleeve.

In one series of embodiments the cut-out has a first depth (D1) of at least 20, 30, 40 or 50 mm. In one series of embodiments the first depth (D1) is no more than 100, 80, 60 or 40 mm. In one embodiment the first depth (D1) is from 25 to 50 mm. The first depth (D1) can be compared to the height of the feeder sleeve. In one embodiment, the first depth corresponds to from 10 to 50% or 20 to 40% of the height of the feeder sleeve.

The cut-out is considered to have a maximum width (W), which is measured in a direction approximately perpendicular to the bore axis and/or the feeder sleeve axis. It will be understood that the width of the cut-out must be sufficient to allow the tubular body to be received in the cut-out. In one series of embodiments the cut-out has a maximum width of at least 0.5, 1, 2, 3, 5 or 8 mm. In one series of embodiments the cut-out has a maximum width of no more than 10, 5, 3 or 1.5 mm. In one embodiment the cut-out has a maximum width of from 1 to 3 mm. This is particularly useful where the cut-out is a groove in order to provide a snug fit for the tubular body. In one embodiment the cut-out has a maximum width of from 5 to 15 mm. This is particularly useful where the cut-out is contiguous with the cavity.

The cut-out may have a uniform width i.e. the width of the cut-out is the same no matter where it is measured. Alternatively, the cut-out may have a non-uniform width. For example, the cut-out may be a groove that tapers inwardly i.e. narrows towards the second end of the feeder sleeve. Hence, the maximum width is measured at the base of the sidewall and the width then reduces to a minimum value at the first depth (D1). This may be used in certain embodiments to control and reduce the amount that the tubular body projects into the sleeve on ram up.

In one series of embodiments the second depth (D2, the depth to which the tubular body is received in the cut-out) is at least 10, 15, 20, 25, 30, 40 or 50% of the first depth. In one series of embodiments the second depth is no more than 90, 80, 70, 60, 50, 40, 30, 20 or 10% of the first depth. In one embodiment the second depth is from 10 to 30% of the first depth. In another embodiment the second depth is from 80 to 100% of the first depth.

Typically, the tubular body projects into the cut-out to a uniform depth i.e. the distance from the base to the end of tubular body is the same no matter where it is measured. However, a tubular body having an uneven edge (e.g. a castellated edge) could be employed if desired such that the distance would vary and the second depth will be understood to be the maximum depth, save that there can be no gap between the tubular body and the base of the sidewall to avoid ingress of moulding sand into the casting.

The nature of the feeder sleeve material is not particularly limited so long as it can be abraded by the tubular body in use and it may be for example insulating, exothermic or a combination of both. Neither is its mode of manufacture particularly limited, it may be manufactured for example using either the vacuum-forming process or core-shot method. Typically a feeder sleeve is made from a mixture of low and high density refractory fillers (e.g. silica sand, olivine, alumino-silicate hollow microspheres and fibres, chamotte, alumina, pumice, perlite, vermiculite) and binders. An exothermic sleeve further requires a fuel (usually aluminium or aluminium alloy), an oxidant (typically iron oxide, manganese dioxide, or potassium nitrate) and usually initiators/sensitisers (typically cryolite).

In one embodiment a conventional feeder sleeve is manufactured and then feeder sleeve material is removed from the base to form the cut-out e.g. by drilling or grinding. In another embodiment the feeder sleeve is manufactured with the cut-out in place, typically by a core-shooting method incorporating a tool that defines the cut-out e.g. the tool has a thin mandrel around which the sleeve is formed, after which the sleeve is removed (stripped) from the tool and mandrel.

It will be understood that the extent of abrasion will depend on factors such as the moulding pressure employed, the relative strength of the materials from which the tubular body and the feeder sleeve are made and the relative rigidity of the abrading region and the feeder sleeve. A softer feeder sleeve will be abraded more easily than a harder feeder sleeve for a tubular body of given strength/rigidity when employing the same moulding pressure. The skilled person can choose a combination which allows relative movement of the feeder sleeve and tubular body on ram-up but avoids compaction during transportation and unnecessary abrasion.

In one series of embodiments the feeder sleeve has a strength (crush strength) of at least 5 kN, 8 kN, 12 kN, 15 kN, 20 kN or 25 kN. In one series of embodiments, the sleeve strength is less than 25 kN, 20 kN, 18 kN, 15 kN, 10 kN or 8 kN. For ease of comparison the strength of a feeder sleeve is defined as the compressive strength of a 50.times.50 mm cylindrical test body made from the feeder sleeve material. A 201/70 EM compressive testing machine (Form & Test Seidner, Germany) is used and operated in accordance with the manufacturer's instructions. The test body is placed centrally on the lower of the steel plates and loaded to destruction as the lower plate is moved towards the upper plate at a rate of 20 mm/minute. The effective strength of the feeder sleeve will not only be dependent upon the exact composition, binder used and manufacturing method, but also on the size and design of the sleeve, which is illustrated by the fact that the strength of a test body is usually higher than that measured for a standard flat topped sleeve.

In one embodiment the feeder sleeve has a strength of at least 20 kN. Suitable feeder sleeves are commercially available from the Applicant under the brand name FEEDEX®. Such high strength feeder sleeves are likely to be useful in a range of applications. In another embodiment the feeder sleeve has a strength of from 8 to 12 kN. Suitable feeder sleeves are commercially available from the Applicant under the brand name KALMINEX®. Such relatively lower strength sleeves are especially useful in embodiments where the tubular body increases the depth of the cut-out on ram-up (i.e. D3>D1) since it will be easier for the tubular body to cut into the feeder sleeve material.

In one embodiment the feeder sleeve comprises a roof spaced from the base of the sidewall. The sidewall and roof together define the cavity for receiving liquid metal during casting. In one such embodiment the roof and the sidewall are integrally formed. Alternatively, the sidewall and the roof are separable i.e. the roof is a lid. In one embodiment both the sidewall and the roof are made from feeder sleeve material.

Feeder sleeves are available in a number of shapes including cylinders, ovals and domes. As such, the sidewall may be parallel to or angled from the feeder sleeve longitudinal axis. The roof (if present) may be flat topped, domed, flat topped dome, or any other suitable shape.

The roof of the sleeve may be closed so that the feeder sleeve cavity is enclosed, and it may also contain a recess (a blind bore) extending partially through the top section of the feeder (opposite the base) to assist in mounting the feeder system on a moulding pin attached to the mould pattern. Alternatively, the feeder sleeve may have an aperture (an open bore) that extends through the whole of the feeder roof so that the feeder cavity is open. The aperture must be wide enough to accommodate a support pin but narrow enough to avoid sand entering the feeder sleeve cavity during moulding. The diameter of the aperture may be compared to the maximum diameter of the feeder sleeve cavity (both measured in a plane perpendicular to the longitudinal axis of the feeder sleeve). In one embodiment the diameter of the aperture is no more than 40, 30, 20, 15 or 10% of the maximum diameter of the feeder sleeve cavity.

In use, the feeder system is typically placed on a support pin to hold the feeder system in the required position on the mould pattern plate prior to the sand being compressed and rammed up. On ram up, the sleeve moves towards the mould pattern surface and the pin, if fixed, may puncture the roof of the feeder sleeve, or it simply may traverse through the aperture or recess as the sleeve moves downwards. This movement and contact of the roof with the pin may cause small fragments of sleeve to break off and fall into the casting cavity, resulting in poor casting surface finish or localised contamination of the casting surface. This may be overcome by lining the aperture or recess in the roof with a hollow insert or internal collar, which may be manufactured from a variety of suitable materials including metal, plastic or ceramic. Thus, in one embodiment, the feeder sleeve may be modified to include an internal collar lining the aperture or recess in the roof of the feeder. This collar may be inserted into the aperture or recess in the sleeve roof after the sleeve has been produced, or alternatively, is incorporated during manufacture of the sleeve, whereby sleeve material is coreshot or moulded around the collar, after which the sleeve is cured and holds the collar in place. Such a collar protects the sleeve from any damage that might be caused by the support pin during moulding and ram up.

The invention also resides in a feeder sleeve for use in the feeder system according to embodiments of the first aspect.

According to a second aspect of the present invention there is provided a feeder sleeve for use in metal casting, the feeder sleeve having a longitudinal axis and comprising a continuous sidewall extending generally around the longitudinal axis and a roof extending generally across the longitudinal axis, the sidewall and the roof together defining a cavity for receiving liquid metal during casting, wherein the sidewall has a base spaced from the roof and (i) a castellated cut-out extends from the base or (ii) a groove extends from the base into the sidewall.

The comments above in relation to the first aspect also apply to the second aspect with the exception that the feeder sleeve of the second aspect must comprise a roof and must comprise either a castellated cut-out or a groove. It will be understood that the castellated cut-out/groove extends away from the base and towards the roof.

In one embodiment the groove has a uniform width. Alternatively the groove has a non-uniform width. In one such embodiment the groove inwardly tapers i.e. narrows away from the base of the sidewall. The use of a tapering groove can be useful in certain embodiments. For example, a tapered groove can help the tubular body abrade the feeder sleeve material.

In one embodiment an aperture (an open bore) extends through the feeder roof. In one such embodiment an internal collar lines the aperture. This embodiment is useful when the feeder sleeve is employed with a support pin as described above.

In one embodiment the roof is closed i.e. no aperture extends through the feeder roof.

According to a third aspect of the present invention there is provided a process for preparing a mould comprising placing the feeder system of the first aspect on a pattern, the feeder system comprising a feeder sleeve mounted on a tubular body; the feeder sleeve having a first end and a second end and a longitudinal axis extending generally between the first and second ends, the feeder sleeve comprising a continuous sidewall extending generally around the longitudinal axis that defines a cavity for receiving liquid metal during casting, the sidewall having a base at the first end of the tubular body; the tubular body defining an open bore therethrough for connecting the cavity to the casting, wherein a cut-out extends into the sidewall from the base to a first depth and the tubular body projects into the cut-out to a second depth, the second depth being equal to or less than the first depth, and the tubular body having at least one abrading region in contact with a surface of the feeder sleeve within the cut-out; surrounding the pattern with mould material; compacting the mould material; and removing the pattern from the compacted mould material to form the mould; wherein compacting the mould material comprises applying pressure to the feeder system such that the abrading region abrades the surface of the feeder sleeve with which it is in contact such that the tubular body is pushed towards the second end of the tubular body.

The mould could be a horizontally parted or a vertically parted mould. If used in a vertically parted moulding machine (such as Disamatic flaskless moulding machines manufactured by DISA Industries A/S) the feeder system is typically placed on the swing (pattern) plate when in the horizontal position during the normal mould making cycle. The sleeves may be placed on the horizontal pattern or swing plate manually or automatically by the use of robots.

When the feeder system is employed in a horizontally-parted mould, it may be possible to balance the feeder sleeve on the tubular body. However, for convenience during transport it may still be desirable to employ an adhesive to keep the parts in place prior to use. Similarly, when the feeder sleeve is employed in a vertically-parted mould it is generally desirable to employ an adhesive to maintain contact between the feeder sleeve and the tubular body prior to ram-up.

The comments above in relation to the first and second aspects also apply to the third aspect.

In one embodiment the second depth is less than the first depth i.e. the tubular body projects partially into the cut-out. The tubular body abrades the sides of the cut-out and moves further into the cut-out. In one series of embodiments the tubular body is pushed further into the cut-out to a third depth (D3), the third depth being at least 50, 60, 70, 80 or 90% of the first depth. In one series of embodiments the third depth is no more than 100, 90, 80 or 70% of the first depth.

In one embodiment the second depth is equal to the first depth i.e. the tubular body projects fully into the cut-out. The tubular body abrades the body of the feeder sleeve at the base of the cut-out, effectively making the cut-out deeper. In one series of embodiments the tubular body is pushed into the feeder sleeve to a third depth (D3), the third depth being at least 101, 105 or 110% of the first depth. In one series of embodiments the third depth is no more than 115, 110, 105 or 103% of the first depth. It will be understood that abrasion is required to cause relative movement of the feeder sleeve and tubular body, but should be controlled to avoid potential casting defects.

In one series of embodiments compacting the mould material comprises applying a ram up pressure (as measured at the pattern plate) of at least 30, 60, 90, 120 or 150 N/cm$^2$.

In one embodiment the mould material is clay bonded sand (usually referred to as greensand), which typically comprises a mixture of clay such as sodium or calcium bentonite, water and other additives such as coal dust and cereal binder. Alternatively the mould material is mould sand containing a binder.

BRIEF DESCRIPTION OF THE DRAWINGS

Embodiments of the invention will now be described by way of example only with reference to the accompanying drawings in which:—

DETAILED DESCRIPTION

Figure 1:
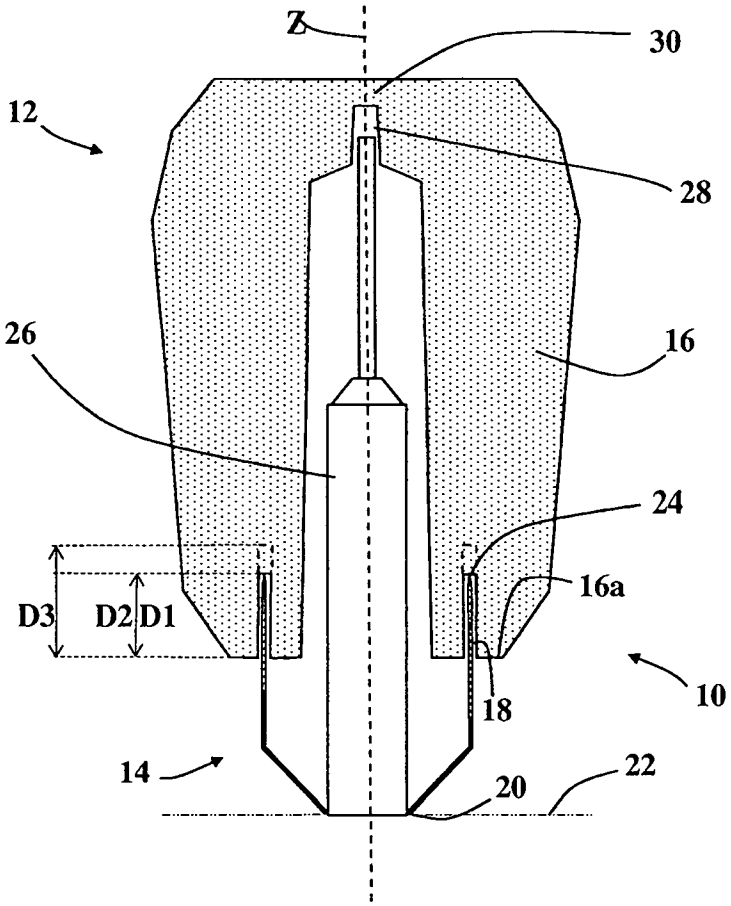
FIG. 1 is a schematic diagram of a feeder system in accordance with an embodiment of the invention.

Referring to FIG. 1 there is shown a feeder system 10 comprising a feeder sleeve 12 having a strength of 8-12 kN mounted on a tubular body 14. The feeder sleeve 12 has a continuous sidewall 16 which extends generally around a longitudinal axis Z; the sidewall 16 defines a cavity for receiving molten metal in use. The sidewall has a base 16*a* from which a groove 18 having parallel sides extends to a depth D1. The groove 18 is separate from the cavity.

The tubular body 14 is pressed from sheet steel and defines an open bore therethough (the bore axis lies along the longitudinal axis Z). The tubular body 14 tapers at its end away from the feeder sleeve to form a feeder neck 20 in contact with a moulding pattern plate 22. The opposite end 24 of the tubular body is sharpened to form a circular blade that projects into the groove 18 and is in contact with the feeder sleeve 12. The tubular body 14 projects to the full depth of the groove (D2=D1). On ram-up the sharpened end 24 of the tubular body 14 cuts into the feeder sleeve 12, thereby increasing the depth of the groove to D3 (shown in dotted lines) and allowing the feeder sleeve to move closer to the casting.

The top of a moulding pin 26 is located in a complementary recess 28 in the roof 30 of the sleeve 12, and on ram up, as the sleeve 12 moves downwards, the top of the moulding pin 26 pierces the thin section at the top of the roof 30. If desired a collar could be fitted in the recess 28 to avoid the risk of fragments of sleeve breaking off when the pin 26 punctures the roof 30. Alternatively a narrow aperture could extend through the roof 30 in place of the recess 28 and thereby accommodate the support pin 26. In this case the aperture would have a diameter corresponding to approximately 15% of the maximum diameter of the feeder sleeve cavity.

Figure 2A:
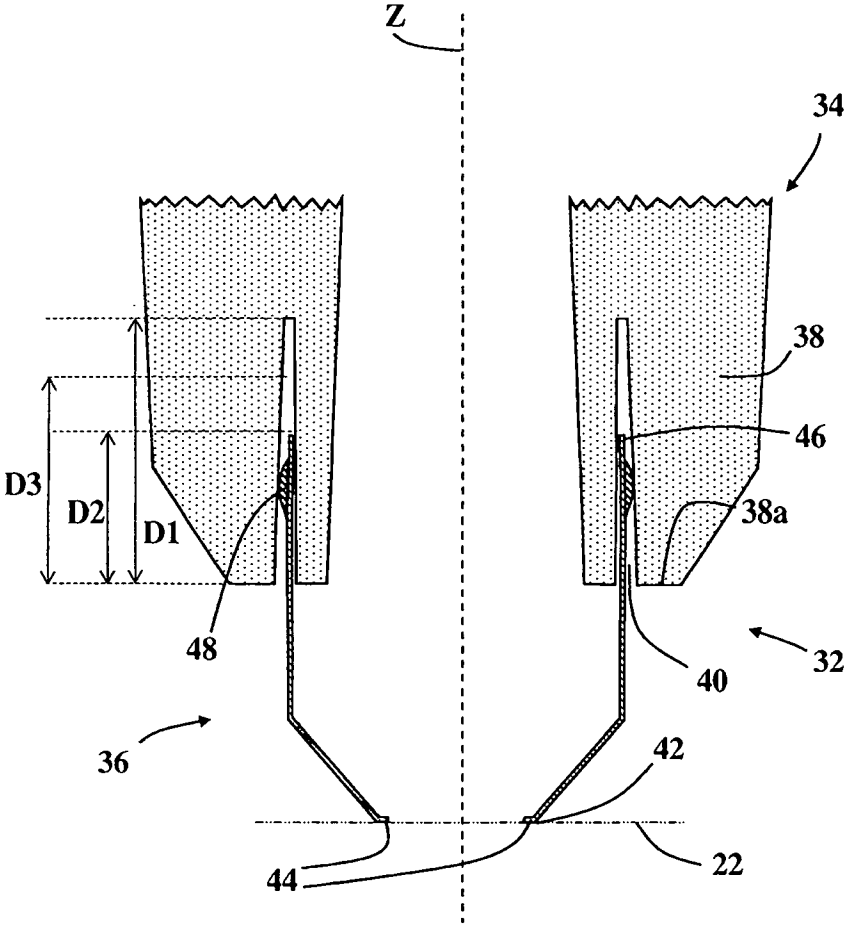
FIG. 2*a* is a schematic diagram of a feeder system in accordance with another embodiment of the invention.

Referring to FIG. 2*a* there is shown a feeder system 32 comprising a feeder sleeve 34 having a strength of at least 20 kN mounted on a tubular body 36. The feeder sleeve 34 has a continuous sidewall 38 which extends generally around a longitudinal axis Z to define a feeder sleeve cavity. The sidewall has a base 38*a* and a tapered groove 40 extends from the base to a first depth D1. The groove 40 has its maximum width at the base 38*a*.

Figure 2B:
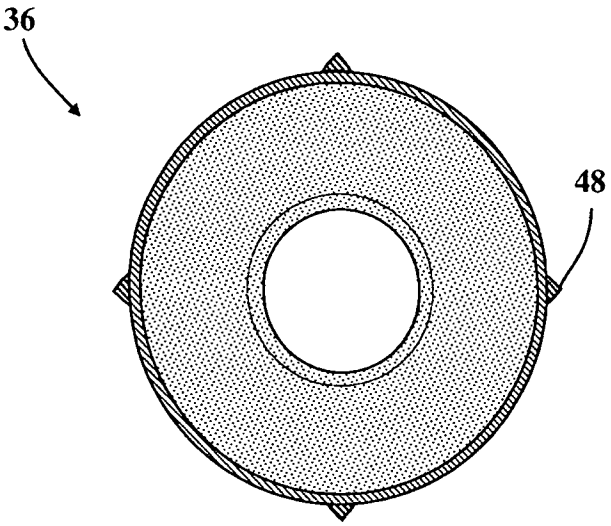
FIG. 2*b* is the tubular body from the feeder system of FIG. 2*a;*

The tubular body 36 is pressed from sheet steel and defines an open bore therethough (the bore axis lies along the longitudinal axis Z). The tubular body 36 tapers at its end remote from the feeder sleeve to form a feeder neck 42 and has an inwardly directed lip or flange 44 at its base that sits on the surface of the pattern plate 22. In use, this produces a notch in the resulting metal feeder neck to facilitate its removal (knock off). The opposite end 46 of the tubular body projects into the groove 40 to a second depth D2. The tubular body 36 is held in place by four fins 48 which project from the sides of the tubular body and make contact with the feeder sleeve 34 within the groove 40. A cross-section of the tubular body 36 is shown in FIG. 2*b*. The fins 48 are sharpened to provide an abrading region and also serve as retaining means.

On ram-up, a force is applied in the direction of the axis Z and the fins 48 scrape against the sides of the feeder sleeve within the groove 40. The tubular body 36 is pushed further into the groove 40 to a depth D3 (D3<D1).

Figure 3A:
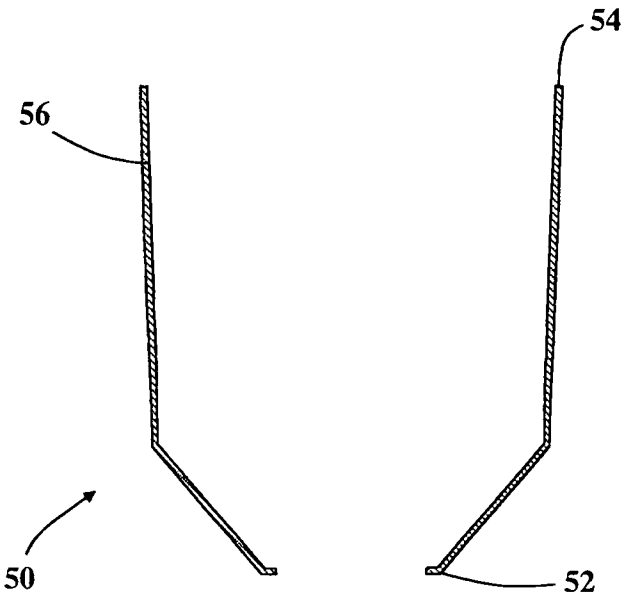
FIG. 3*a* is a tubular body for use the feeder systems of FIG. 3*b* and FIG. 3*c;*

Referring to FIG. 3*a* there is provided a tubular body 50 for use in a feeder system of the invention. The tubular body 50 tapers inwardly at a first end to form a feeder neck 52. The main sidewall 56 of the tubular body is frustoconical, tapering outwardly toward the second end 54. The end 54 serves as an abrading region in use and can be sharpened if desired.

Figure 3C:
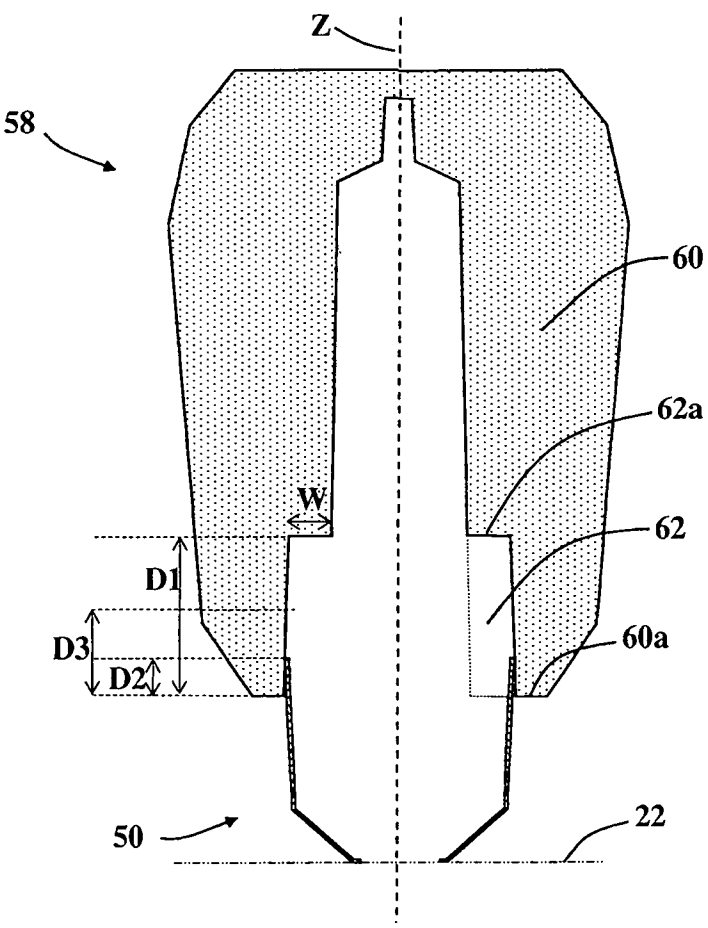
Figure 3B:
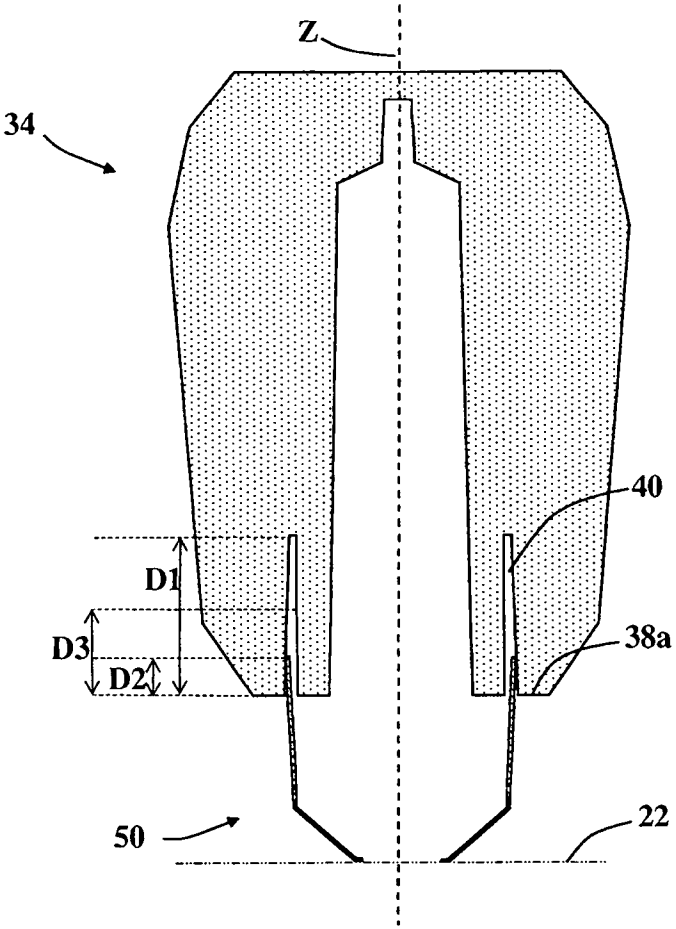

Referring to FIG. 3*b* the feeder sleeve 34 (as in FIGS. 2*a*-2*b*) is mounted on the tubular body 50 to provide a feeder system. The outwardly tapering end of the tubular body 50 projects into the groove 40 to a depth D2. The outward taper ensures that the tubular body 50 contacts the sides of the groove 40 and thereby provides a friction fit. On ram-up the tubular body 50 is pushed further into the groove 40 to a depth D3 (D3<D1) and the end 54 abrades the surface of the feeder sleeve 34 within the groove 40.

Referring to FIG. 3*c* a feeder sleeve 58 is mounted on the tubular body 50 to provide a feeder system. The feeder sleeve 58 has a continuous sidewall 60 which extends generally around a longitudinal axis Z; the sidewall 16 defines a cavity for receiving molten metal in use. The sidewall has a base 60*a* from which a cut-out 62 extends to a depth D1. The end of the cut-out 62 is defined by the ledge 34*a*. The cut-out 62 is contiguous with the feeder sleeve cavity and has a width W measured radially from the axis Z. The outwardly tapering end 54 of the tubular body projects into the cut-out 34 to a depth D2. The outward taper ensures that the tubular body 50 contacts the side of the cut-out 34 and thereby provides a friction fit. On ram-up the tubular body 50 is pushed further into the cut-out 34 to a depth D3 (D3<D1) and abrades the surface of the feeder sleeve 58 within the cut-out.

Figure 4B:
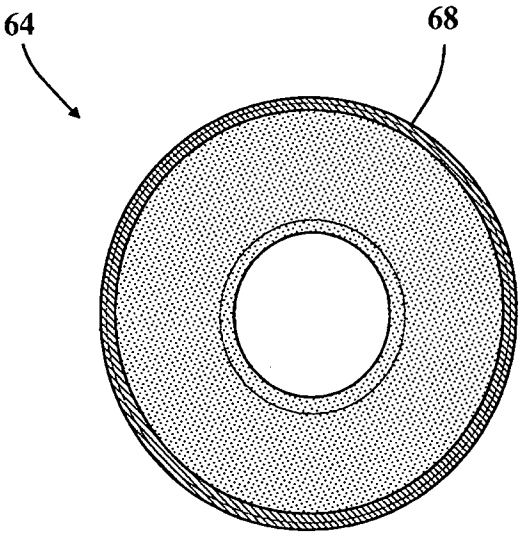
FIG. 4*b* is a top view of the tubular body showing a circular cross section.
Figure 4A:
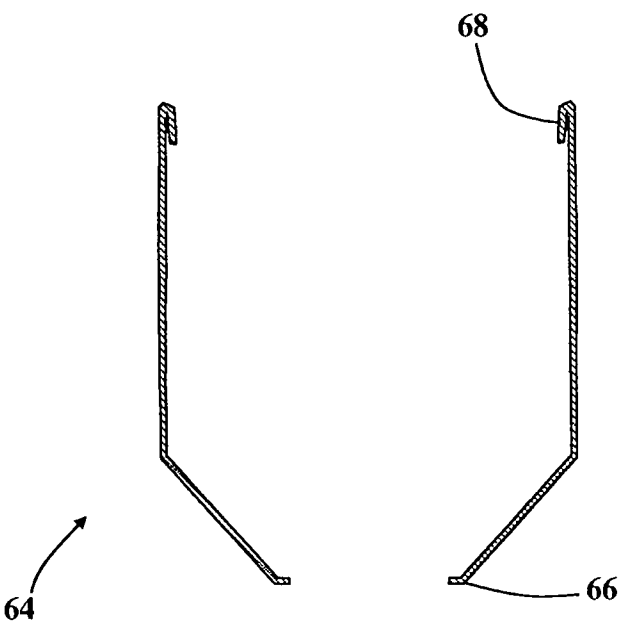
FIG. 4*a* is a tubular body for use in a feeder system in accordance with the invention.

Referring to FIG. 4*a* there is provided a cross-section of a tubular body 64. As previously, the tubular body tapers at one end to form a feeder neck 66. The opposite end of the tubular body 64 is folded inwardly to form an overlap 68. The overlap 68 provides an abrading surface. FIG. 4*b* provides a top view of the tubular body which shows a circular cross-section. The tubular body 64 can be employed with a feeder sleeve having a groove (including parallel or tapered) so that it partially projects into the groove.

Figure 5B:
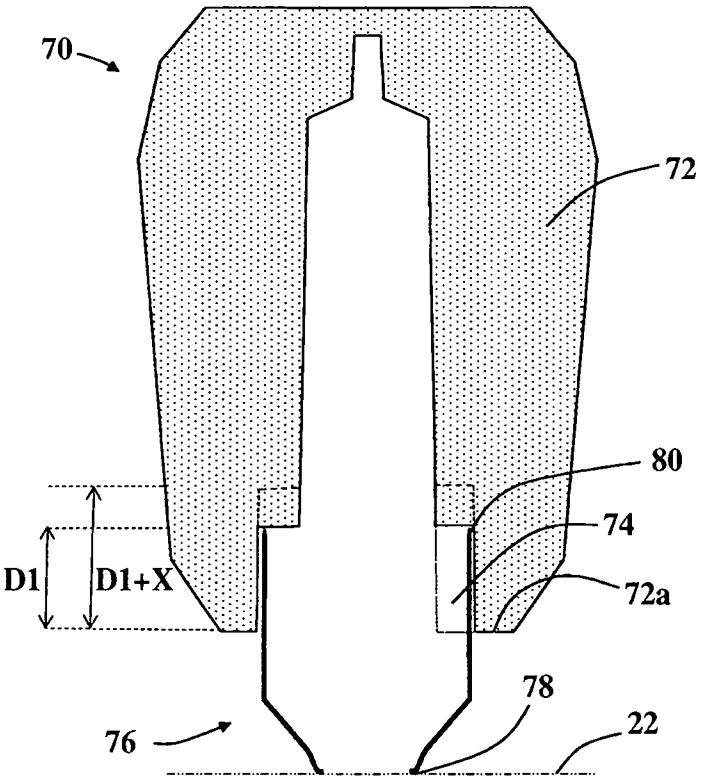
FIG. 5*a* shows a feeder sleeve for use in the feeder system of FIG. 5*b*.
Figure 5A:
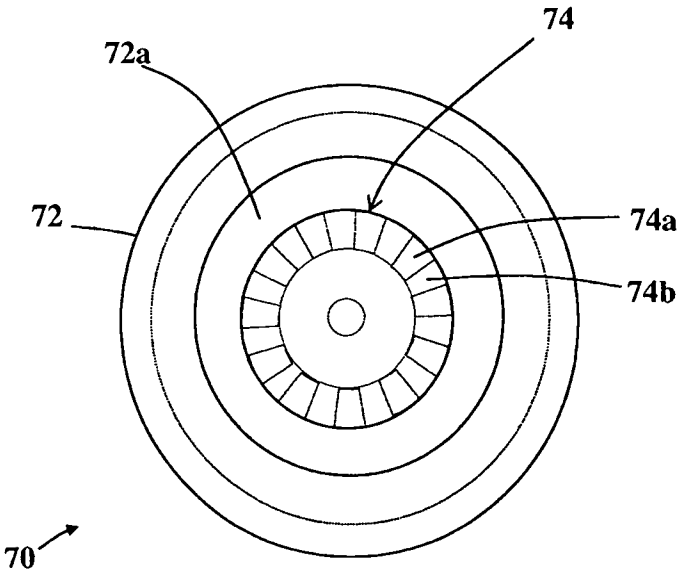

FIG. 5*a* shows a view from below of a feeder sleeve 70 for use in a feeder system. The feeder sleeve has a circular cross section and comprises a continuous sidewall 72 that defines a cavity. The base 72*a* of the sidewall has a cut-out 74 of non-uniform depth, which is castellated. Alternating first regions 74*a* and second regions 74*b* have a depth of D1 and (D1+x) respectively, as measured from the base 72*a*.

FIG. 5*b* shows a feeder system comprising the feeder sleeve 70 mounted on a tubular body 76. At one end, the tubular body 76 tapers in two stages to form a feeder neck 78 (which has a different profile from that shown in other embodiments). The feeder neck 78 is thought to provide additional rigidity to the tubular body. The opposite end of the tubular body has a sharp end 80 that projects into the feeder sleeve so that the sharp end 80 abuts the first regions 74*a* of the cut-out 74 at a depth D1. On ram-up, the tubular body 68 cuts further into the feeder sleeve material and the presence of the deeper cut-outs makes the feeder sleeve easier to abrade.

What is claimed is:

1. A feeder system for metal casting comprising a feeder sleeve on a tubular body;

the feeder sleeve having a first end and a second end and a longitudinal axis extending generally between said first and second ends, and comprising a continuous sidewall extending generally around the longitudinal axis that defines a cavity for receiving liquid metal during casting, the sidewall having a base at the first end of the feeder sleeve;

the tubular body defining an open bore therethrough for connecting the cavity to a casting, wherein:

at least one cut-out extends into the sidewall from the base to a first depth, and the tubular body projects into the at least one cut-out to a second depth, the tubular body having at least one abrading region in contact with a surface of the feeder sleeve within the at least one cut-out and the second depth being equal to or less than the first depth so that upon application of a force in use the at least one abrading region abrades the surface of the feeder sleeve with which it is in contact such that the tubular body is pushed towards the second end, wherein the at least one cut-out is a groove in the sidewalk, wherein the at least one cut-out is separate from and not contiguous with the cavity.

2. The system of claim 1, wherein the groove is inwardly tapered towards the second end of the feeder sleeve.

3. The system of claim 1, wherein the at least one cut-out is castellated.

4. The system of claim 1, wherein retaining means are employed to hold the tubular body in position at the second depth within the at least one cut-out.

5. The system of claim 4, wherein (i) the at least one abrading region constitutes the retaining means; (ii) the at least one cut-out and the tubular body are sized such that the retaining means is a friction fit; and/or (iii) the tubular body is releasably fixed to the feeder sleeve by adhesive.

6. The system of claim 1, wherein the at least one abrading region comprises at least one outward projection which abuts the feeder sleeve within the at least one cut-out.

7. The system of claim 6, wherein the at least one outward projection is a fin.

8. The system of claim 1, wherein the at least one abrading region comprises (i) at least one sharp edge or (ii) at least one sharp point.

9. The system of claim 1, wherein the tubular body is a metal tubular body or a plastics tubular body.

10. The system of claim 9, wherein the metal is steel with a carbon content of less than 0.05% by weight.

11. The system of claim 1, wherein the feeder sleeve has a height measured along the longitudinal axis and the first depth corresponds to 10 to 40% of the height.

12. The system of claim 1, wherein the feeder sleeve has a crush strength of at least 20 kN.

13. A feeder sleeve for use in the feeder system of claim 1, the feeder sleeve having a longitudinal axis and comprising a continuous sidewall extending generally around the longitudinal axis and a roof extending generally across the longitudinal axis, the sidewall and roof together defining a cavity for receiving liquid metal during casting, wherein the sidewall has a base spaced from the roof and a groove extends from the base into the sidewalk, wherein the groove is separate from and not contiguous with the cavity.

14. A process for preparing a mould comprising placing the feeder system of claim 1 on a pattern plate, the feeder system comprising a feeder sleeve mounted on a tubular body;

the feeder sleeve having a first end and a second end and a longitudinal axis extending generally between the first and second ends, the feeder sleeve comprising a continuous sidewall extending generally around the longitudinal axis that defines a cavity for receiving liquid metal during casting, the sidewall having a base at the first end of the feeder sleeve;

the tubular body defining an open bore therethrough for connecting the cavity to the casting, wherein a cut-out extends into the sidewall from the base to a first depth and the tubular body projects into the cut-out to a second depth, the second depth being equal to or less than the first depth, and the tubular body having at least one abrading region in contact with a surface of the feeder sleeve within the cut-out;

surrounding the pattern with mould material;

compacting the mould material; and removing the pattern from the compacted mould material to form the mould;

wherein compacting the mould material comprises applying pressure to the feeder system such that the at least one abrading region abrades the surface of the feeder sleeve with which it is in contact such that the tubular body is pushed towards the second end of the tubular body, wherein the cut-out is separate from and not contiguous with the cavity.

15. The process of claim 14, wherein the second depth is less than the first depth such that compacting the mould material causes the tubular body to abrade the sides of the cut-out and move further into the cut-out to a third depth.

16. The process of claim 14, wherein the second depth is equal to the first depth such that compacting the mould material causes the tubular body to abrades the feeder sleeve at a base of the cut-out, effectively making the cut-out deeper.

17. The process of claim 14, wherein compacting the mould material comprises applying a ram-up pressure of at least 30 $N/cm^2$.

* * * * *